United States Patent [19]

Danks

[11] 4,132,334

[45] Jan. 2, 1979

[54] SPILL AND TAMPER RESISTANT SAFETY CLOSURE

[75] Inventor: Barbara A. Danks, Gurnee, Ill.

[73] Assignee: Abbott Laboratories, North Chicago, Ill.

[21] Appl. No.: 794,766

[22] Filed: May 9, 1977

[51] Int. Cl.[2] ..... B65D 5/72

[52] U.S. Cl. ..... 222/490; 141/348; 222/589

[58] Field of Search ..... 222/490, 587, 589, 494; 15/257.075; 141/348

[56] References Cited

U.S. PATENT DOCUMENTS

| | | | |
|---|---|---|---|
| 864,389 | 8/1907 | Scozzafava | 222/589 |
| 1,241,352 | 9/1917 | Doering et al. | 222/490 X |
| 2,105,615 | 1/1938 | Romeis | 222/494 |
| 3,558,022 | 1/1971 | Zytko | 222/490 |

FOREIGN PATENT DOCUMENTS

| | | | |
|---|---|---|---|
| 1213386 | 3/1960 | France | 222/494 |

*Primary Examiner*—Robert B. Reeves
*Assistant Examiner*—David A. Scherbel
*Attorney, Agent, or Firm*—Gildo E. Fato; Robert L. Niblack

[57] ABSTRACT

Disclosed is a single piece integrally formed safety closure for a container including a body portion designed for fluid tight engagement with the neck and finish of a container and a depending portion including a passageway which extends into the container. A valve is integrally formed in the side wall of the closure and opens upon insertion of a dropper-dispenser. The valve closes upon removal of the dropper, thereby preventing spillage or inadvertent removal of the contents of the container.

5 Claims, 3 Drawing Figures

SPILL AND TAMPER RESISTANT SAFETY CLOSURE

BACKGROUND OF THE INVENTION

Many pharmaceuticals in the form of a liquid or suspension are provided in containers including a dropper dispenser for dispensing the medicament within the container. Nose, eye, and ear droppers as well as pediatric pharmaceuticals are typically provided in such containers. Usually the dropper is incorporated into the container cap which in most cases is a screw cap. Since some pharmaceuticals can cause undesirable effects if not used properly, there has been increasing concern for infants and children to whom such containers may be accessable. With screw cap closures, the danger of possible overdosage by children is present since such closures are easily removable. Closures which readily allow access to the contents of such containers but at the same time minimize the opportunity for a child to ingest excessive amounts of the medicament are desirable. One such closure is described in U.S. Pat. No. 3,558,022 issued Jan. 26, 1971. This closure is inserted within the neck of the container and includes a movable closure element which is urged into a closed position by a helical spring positioned about the depending portion of the closure. When the dropper is inserted into the bottle through the closure, the movable closure element is opened by pressure exerted by the dropper. After the dropper is filled with medicament and removed, the spring urges the movable closure element into the closed position thereby preventing any further medicament from being removed from the bottle. This closure however is somewhat complex, includes two parts, and is expensive to assemble because of the need to attach a spring to the closure and thereafter insert the closure within the container.

BRIEF SUMMARY OF THE INVENTION

The safety closure of the present invention comprises a single piece integrally formed element comprising a portion designed for fluid tight engagement with the neck and finish of the container so that no leakage results. A depending portion including a passageway which extends into the container and a valve which is integrally formed in the side wall of the body of the closure and is attached to close off the opening or passageway in the closure. By forming the valve in a length greater than the width or diameter of the passageway, the possibility of leaking of medicament past the closed valve is minimized. As with the closure described in U.S. Pat. No. 3,558,022, when the dropper is inserted in the closure, the valve is pushed aside allowing access of the dropper to the medicament. When the dropper is removed, the valve will return to its original position due to its own elasticity thereby closing the opening and preventing the contents from spilling out or otherwise being removed from the container. As a consequence, a child would be unable to drink the contents of the container by simply removing the stopper. The single piece construction provides economy in both fabrication and labor and can be inserted automatically or by hand into either glass or plastic containers. The closure can be formed by injection molding from materials such as medium or high density polyethylene or polyproplene and does not require assembly of separate components as is required by the closure of U.S. Pat. No. 3,558,022.

DESCRIPTION OF THE DRAWINGS

In order to better understand the invention, reference can be made to the attached drawings wherein.

DETAILED DESCRIPTION OF THE INVENTION

Figure 1:
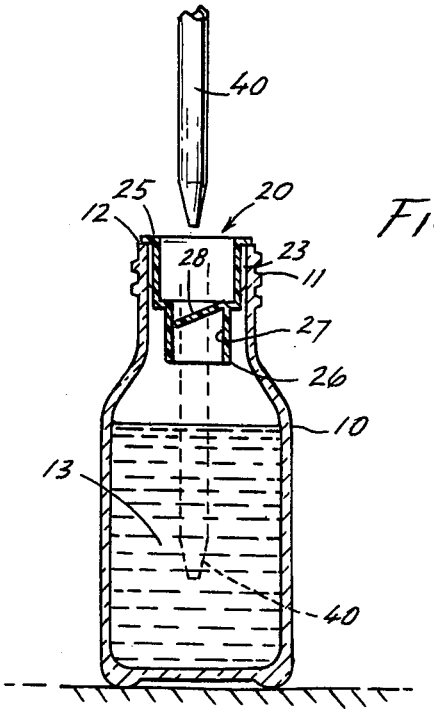
FIG. 1 is a side elevational view in cross section of a container having an embodiment of a safety closure of the present invention inserted within the neck portion thereof.
Figure 2:
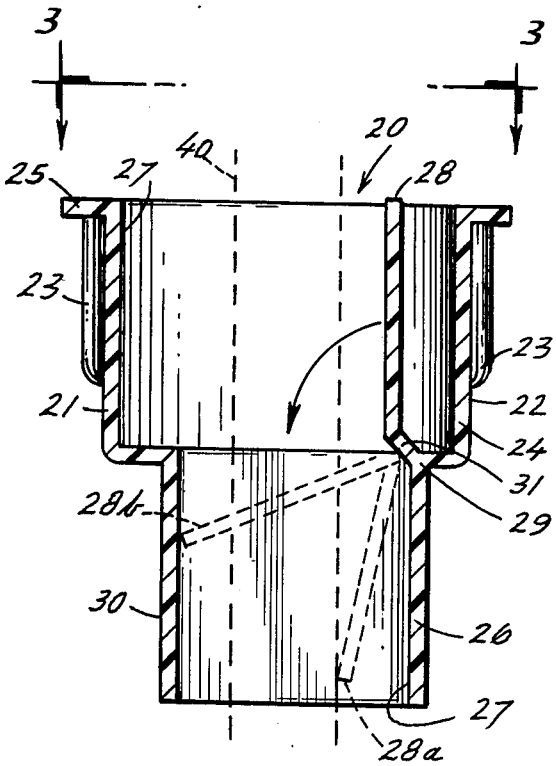
FIG. 2 is a side elevational view in cross section of an embodiment of the safety closure of the present invention.
Figure 3:
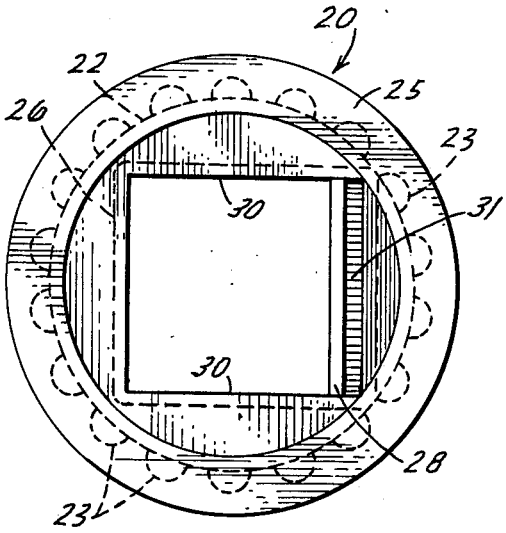
FIG. 3 is a top plan view of the safety closure as viewed along the lines 3—3 of FIG. 2.

FIG. 1 illustrates a container 10 having a spill and tamper resistant safety closure 20 inserted within the neck portin 11 of the container 10 in fluid tight engagement therewith and with the finish 12 of the container. The safety closure 20 is best illustrated in FIGS. 2 and 3 and comprises a single piece, integrally formed element 21 adapted for fluid tight engagement with the neck and finish of a container so that no leakage results. The safety closure 20 includes a container engaging body portin 22 having a passageway 27 therethrough and which is adapted to conform in fluid tight engagement with the opening or neck portion 11 of the container. As illustrated, the body portion 22 is round but can be formed in any configuration to conform with the configuration of the neck portion of the container with which it is to be used. The body portion 22 of the closure 20 includes a plurality of spaced verticle ribs 23 formed in the wall 24 of the body portion 22. The ribs 23 assist in creating an effective friction fit with the neck 11 of the container 10 when the closure 20 is inserted within the neck 11. When inserted within the neck 11 of the container 10 the annular flange 25 extending from the wall 24 of the body portin 22 of the closure 20 rests on the finish 12 of the container 10 thereby preventing leakage of any of the contents 13 of the container 10. If desired, the ribs 23 can be formed in the wall 24 of the body portion 22 in a horizontal position. While the closure 20 need not be formed with ribs 23 in the walls 24 of the body portion 22, straight walls without ribs formed therein would not create as tight a fit when inserted within the neck of a container because of variation in the diameter of the neck or the body portion of the closure itself. The ribs 23 are preferred because they flex and thereby permit a tight fit regardless of minor variations in the diameter of the neck 11 or the closure 20. Likewise, if the ribs 23 are not formed in the wall 24, then the annular flange 25 may not be required. As with the ribs 23, the flange 25 is preferred since it seats tightly against the finish 12 of the container 10 thereby minimizing the possibility of any leakage from the container 10. Even with a straight wall 24, not including any ribs 23, the flange 25 would prevent leakage in the event of variations in the neck 11 or body 22 diameter or imperfections in the surfaces of either which would permit fluid 13 to escape.

Extending from the body portion 22 of the closure 20 is a depending portion 26 which is rectilinear in configuration and forms a passageway 27 which extends through the body portion 22 and into the container 10 when the closure 20 is positioned in place. A valve member 28 is molded in an upright position in the closure 20, extending inwardly from the junction 29 oif the body portion 22 and the depending portion 26 of the closure 20 and conforms with the configuration of the depending portion. In use, the valve 28 is forced into position into the depending portion 26 as illustrated by the dotted lines in FIG. 2. The length of the valve 28 is preferably longer than the width of the passageway 27 formed by the walls 30 of the depending portion 26 of the closure 20. A length of less than the width of the passageway 27 would of course permit leakage and a length of the same dimension as the width of the passageway 27 might likewise permit leakage.

The valve 28 includes a hinge portion 31 which preferably is formed in the same width as that of the valve 28. A hinge 31 of the same width as that of the valve 28 provides a greater bias to the valve 28 and thereby less chance of any leaking resulting. While a width of the hinge 31 less than the width of the valve 28 would be operable, it is not as desirable as a width equal to that of the valve 28. If the width of the hinge 31 is half or less that of the valve 28, then the hinge 31 will be deformed if a dropper 40 is left in place for any length of time. Since the container 10 is generally used with the dropper 40 in place, it is desirable that deformation of the hinge 31 be avoided. If deformation does result, then the valve 28 will not close well when the dropper 40 is removed and leaking will result.

The closure 20 can be integrally formed into a single piece by conventional injection molding techniques from plastic materials such as polyethylene or polyproplene and can be easily inserted into the neck 11 of the container 10, the flange 25 acting as an automatic stop, In use, the filled container 10 with the closure 20 inserted therein is sealed with a conventional screw-type cap (not shown) with the dropper 40 separate therefrom. When it is desired to administer the contents 13 of the container 10, the screw cap is removed and the dropper 40 is inserted into the closure, into contact with the valve 28. and then into the container 10 through the passageway 27 in the depending portion 26 of the closure 20. After the dropper-dispenser 40 is filled with the contents 13 of the container 10, it is withdrawn from the container 10 and the closure 20. As the dropper 40 is removed, the valve 28 will move from the open position illustrated by the valve 28*a*, to the closed position illustrated by the valve 28*b*, all in FIG. 2. When the valve 28 is in the closed position, the contents 13 of the container 10 cannot leak out even though the screw cap is not put in place. Thus, if the container 10 should tip or fall over, the contents 13 readily be removed from the container 10 by a child even with the screw cap removed.

What is claimed is:

1. A spill and tamper resistant safety closure for a container having an opening or neck portion comprising;

an integrally formed element defining a container-engaging body portion and a depending portion extending from the engaging portion, both said container-engaging body portion and said depending portion having a wall member forming a continuous passageway therethrough, said passageway including an opening into the container, a movable valve member positioned within said passageway distal from the opening and extending inwardly from the walls thereof and hingedly secured inside said safety closure, said hinging being effected solely by means of an integral connection between the wall of the closure and said movable valve member, the valve member conforming to the configuration of the depending portion and being of a length longer than the width of the passageway, said container-engaging body portion adapted to sealingly fit inside the neck portion of said container in fluid tight engagement therewith.

2. The spill and tamper resistant safety closure as defined in claim 1 wherein said movable valve member is constructed and arranged of a length longer than the width of the passageway to engage the inside wall surface forming said continuous passage in an angular position when said valve is closed.

3. The spill and tamper resistant safety closure as defined in claim 2 wherein said movable valve member and hinge thereof is molded as a portion of the junction between the depending portion and the container-engaging body portion of the safety closure.

4. The spill and tamper resistant safety closure as defined in claim 1 wherein said movable valve member is hinged by means of a weakened portion between the movable sealing member and said wall member, said weakened portion being no less than one-half the width of the valve.

5. The spill and tamper resistant safety closure as defined in claim 4 where said depending portion is formed in a rectilinear configuration, said valve conforming with said configuration to thereby seal the passageway when in the closed position.

* * * * *